US010010200B2

(12) United States Patent
Lane et al.

(10) Patent No.: US 10,010,200 B2
(45) Date of Patent: Jul. 3, 2018

(54) LID WITH STRAW

(71) Applicant: THERMOS L.L.C., Schaumburg, IL (US)

(72) Inventors: Marvin Lane, Wheeling, IL (US); Dwayne Boroski, Lake in the Hills, IL (US)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 15/092,849

(22) Filed: Apr. 7, 2016

(65) Prior Publication Data

US 2016/0296051 A1 Oct. 13, 2016

Related U.S. Application Data

(60) Provisional application No. 62/144,883, filed on Apr. 8, 2015.

(51) Int. Cl.

| | |
|---|---|
| ***A47G 19/22*** | (2006.01) |
| ***B65D 47/06*** | (2006.01) |
| ***B65D 47/32*** | (2006.01) |
| *B65D 25/40* | (2006.01) |

(52) U.S. Cl.

CPC ..... *A47G 19/2266* (2013.01); *B65D 47/066* (2013.01); *B65D 47/32* (2013.01)

(58) Field of Classification Search

CPC ..... A47G 19/2266; A47G 19/2272; A47G 19/2222; A47G 21/18; B65D 47/066; B65D 47/32; B65D 72/28; B65D 47/065

USPC ..... 220/708, 707, 705, 709, 714; 215/388

See application file for complete search history.

(56) References Cited

U.S. PATENT DOCUMENTS

| | | | | |
|---|---|---|---|---|
| 6,116,458 | A * | 9/2000 | Dark | A47G 19/2266 220/708 |
| 6,523,711 | B1 * | 2/2003 | Hughes | A47G 19/2266 215/308 |
| 8,307,755 | B2 * | 11/2012 | Shen | A47J 31/005 220/501 |
| 8,672,174 | B1 * | 3/2014 | McMullin | A47G 21/18 215/229 |
| 8,844,742 | B2 * | 9/2014 | Fujita | A47G 19/2266 215/307 |
| 2002/0040909 | A1 * | 4/2002 | Goto | A47G 19/2266 220/709 |
| 2005/0029271 | A1 * | 2/2005 | McDonough | A47G 19/2266 220/709 |
| 2005/0115967 | A1 * | 6/2005 | Conaway | A47G 19/2266 220/254.1 |
| 2009/0120946 | A1 * | 5/2009 | Hung | B65D 47/305 220/707 |

(Continued)

*Primary Examiner* — J. Gregory Pickett
*Assistant Examiner* — Niki M Eloshway
(74) *Attorney, Agent, or Firm* — Polsinelli PC

(57) ABSTRACT

A lid with a straw for a beverage container is described. The lid includes a supporting structure to house the straw. The lid includes a door structure to close the straw. The door structure is rotatably or pivotally connected to the supporting structure. The lid includes a vent to prevent a vacuum from forming in the interior of the beverage container. The door structure also bends the straw to cover the vent in order to close the vent. The supporting structure positions the straw at an optimal angle towards a user's mouth when the straw is released from the supporting structure by opening the door structure.

22 Claims, 7 Drawing Sheets

(56) References Cited

U.S. PATENT DOCUMENTS

| | | | | |
|---|---|---|---|---|
| 2009/0255944 | A1* | 10/2009 | Yamashita | A47G 19/2266 220/705 |
| 2010/0170902 | A1* | 7/2010 | Britto | B65D 47/066 220/367.1 |
| 2012/0305559 | A1* | 12/2012 | Steininger | B65D 47/065 220/253 |
| 2015/0173539 | A1* | 6/2015 | Mason | A47G 19/2272 220/707 |

* cited by examiner

LID WITH STRAW

CROSS REFERENCE TO RELATED APPLICATION

This application claims the benefit of U.S. Provisional Patent Application 62/144,883 filed Apr. 8, 2015, which is hereby incorporated by reference.

FIELD OF INVENTION

The present invention relates to a lid with a straw for use with a container such as a beverage container.

DESCRIPTION OF RELATED ART

The use of drinking straws, paper or plastic, have been known in the prior art for quite some time. Drinking straws provide a sanitary device for withdrawing liquids from containers such as bottles or glasses that allow the user to not put one's mouth or lips on the container.

In order to draw liquid from a covered container through a straw, a vent is usually required to let air in and out to balance air pressure inside the straw, as well as the air pressure in a top chamber above the liquid in the container, and to prevent the liquid from overflowing or failing to be drawn up through the straw. A diameter of a vent opening determines the amount of air going in and out of the container. When the vent is small, it prevents the liquid from leaking from the container through the vent opening. However, a small vent may not allow sufficient airflow for the straw to properly function. When the vent is large, the liquid in the covered container tends to leak through the vent. To resolve this problem, some products use an elastic material cut with slits to allow the vent to open inward slightly to let the air flow. When the container is not in use, the slits do not open, and the vent stays nearly closed. This method is ineffective unless the slits open wide enough to enable the straw to pull up liquid when used. Further, when the straw container is not used, the vent is not actually sealed and allows evaporation. Moreover, when the ambient air pressure or temperature changes, the liquid in the container is easily pushed out through the vent or the straw if the vent is clogged or inadequate for proper pressure relief Another conventional method is to use a vent cover to prevent leakage or evaporation. The inconvenience to the user and the manufacturer alike due to an extra component is apparent. Therefore, a new structure and method of positioning and operating the straw and vent of a beverage container is needed not only for the function of the product and convenience of users, but also for the manufacturing economics.

Some conventional containers also maintain their straw in an exposed or upright position on a constant basis, which may lead to contamination of the straw and/or the beverage in the container.

Some conventional containers also use a handle that is a separate component that is attached or affixed to the container.

SUMMARY OF INVENTION

Certain embodiments of lid with a straw for a beverage container are shown and described. The lid includes a supporting structure to house the straw. The lid includes a door structure to close the straw. The door structure is rotatably or pivotally connected to the supporting structure.

The lid includes a vent to prevent a vacuum from forming in the interior of the beverage container. The door structure also bends the straw to cover the vent in order to close the vent. The supporting structure positions the straw at an optimal angle towards a user's mouth when the straw is released from the supporting structure by opening the door structure. The lid provides for the straw and the vent to be opened or secured simultaneously.

The door structure pivots or rotates downward to urge a first end of the straw into a groove of the supporting structure to cover the vent with the straw, to interlock a latching member of the door structure with the supporting structure, and to urge a pinching member of the door structure against an exterior of the straw. When the door is latched in a closed position, the straw is pinched closed and the vent is covered by the exterior of the straw to close the vent.

The supporting structure may include an arch shape. The groove may be formed in the arch shape. The straw may bend in the shape of the arch and fit into the groove. The supporting structure may include a bridge member passing over a section of the groove. The bridge member may be relatively thin and shaped to abut against only a small portion of the straw or may be relatively wider and cover a larger section of the straw. The bridge member assists in directing the straw at a proper angle for drinking. In certain aspects, the bridge member may include a continuous component that extends from the first top edge of a groove side wall to the adjacent top edge of a groove side wall. Alternatively, the bridge member may include one or more extensions from the top edge of the groove side wall, such extensions configured to hold the straw in the groove, but also configured such that the straw can be pushed into the groove around the extensions without requiring the straw to be strung through an enclosed groove space. Such extensions extend over the space above the groove, but only attach to (or are integral with) one top edge of a groove side wall, rather than both top edges of the groove side wall.

The present application overcomes problems inherent in the prior art. The door structure is configured to secure the straw and the vent when the container is not in use. In a closed position, the door of the lid pinches the straw shut and covers the vent to close off the vent, which reduces leaking. When the door is opened, the straw moves to a ready position and opens the vent. When the container is not in use, the end of the straw is not exposed, which protects the integrity of the beverage.

In one aspect, a lid with a straw for a beverage container is described. The lid includes a supporting structure forming an arch. The arch includes a groove, which is sized to house a first end of the straw. The supporting structure also includes or forms a bridge member that extends across the groove to hold the first end of the straw toward the groove or direct the first end of the straw to a ready position configured for a user to easily drink from the straw. A docking portion is at a first end of the arch. The docking portion includes a vent opening and a ledge. The door structure includes a latching member, a pinching member, and a lifting member. At one end, the door structure is rotatably connected to the supporting structure. The door structure rotates downward to urge the first end of the straw into the groove to simultaneously close the straw and seal the vent opening. The latching member of the door structure interlocks with the ledge of the docking portion to maintain the closed position of the door structure.

In another aspect, a lid with a straw for a beverage container is described. The lid includes a lid body. The lid body includes a groove. The groove is sized to receive a first end of the straw. A bridge member extends across the groove to hold the first end of the straw in a section of the groove. Certain aspects may not include the bridge member, but instead include a partially covered groove to facilitate proper positioning of the straw. However, one advantage of a bridge member instead of a partially covered groove is that the user can more easily help thread the straw through the groove when re-assembling the straw and lid after cleaning the pieces. A docking portion is at a first end of the lid body. The docking portion includes a vent opening and a ledge. A door structure includes a latching member and a pinching member. At one end, the door structure is pivotally connected to the supporting structure. The door structure pivots downward to urge the first end of the straw into the groove to cover the vent opening with the straw and to close the first end of the straw. To maintain the door structure in a closed position, the latching member of the door structure interlocks with the ledge of the docking portion. When closed, the pinching member of the door structure is urged against an exterior of the straw.

In another aspect, a lid with a straw for a beverage container is described. The lid includes a lid body having an upper surface. The upper surface includes a groove. The groove is sized to house a first end of the straw. An end of the upper surface comprises a vent opening and a ledge. A door structure includes a latching member and a pinching member. The door structure is rotatably connected to the lid body. The door structure rotates downward to urge the first end of the straw into the groove to cover the vent opening with an outer surface of the straw, to urge the pinching member against the straw, and to interlock the latching member of the door structure with the ledge of the docking portion.

In another aspect, a lid with a straw for use in a portable beverage container having a container main body is described. The lid includes a supporting structure forming an arch. A groove for housing a first end of the straw is formed by the arch. A pair of connection receiving members are on side walls of the arch. A bridge member extends across the groove to hold the first end of the straw toward the groove. A docking portion is at the first end of the arch, which includes a vent opening and a ledge. A door structure comprises at least one arm, a protruding member, a latching member, a pinching member, and a lifting member, wherein the door structure is attachable to the arch through pairing the protruding member with the connection receiving members. The door structure urges the first end of the straw downward and into the groove to seal the vent opening, and simultaneously interlocks the latching member with the ledge. Further, the pinching member of the door closes the first end of the straw when the door structure is in a locked position. Such a lid with a straw uses a minimal number of components to operate the straw and the vent opening at the same time. Covering the vent opening using the straw minimizes leakage and evaporation.

In another aspect, the supporting structure of said lid with a straw further comprises a stop, and wherein the door is fixed in an opening position when wedged under the stop. In one aspect, the supporting structure has two stops, one on each side of the outer surface of the arch, which may be positioned toward the second end of the supporting structure away from the docking portion. In some aspects, the stop is made of material having resilience, such that a slight force exerted by a user can manually push the arm of the door under the stop in order to keep the door open or pull the arm away from the stop in order to close the door. In some aspects, the stop is a protruding element integral to the outer surface of the arch.

In another aspect, a lid with a straw for use in a portable beverage container includes a bridge member containing an opening for holding the first end of the straw and bending the straw at a fixed angle. The opening allows the first end of the straw to bend towards the groove, and the opening forms the angle so that the first end of the straw point towards the mouth of a user as the door structure opens. In some aspects, the straw is made of a material with resilience. When the door opens, the tension released from the straw pushes the straw upward until it reaches the angle that the bridge member allows, thereby reaching a ready position for drinking.

In another aspect, the supporting structure or arch provides a carrying handle for the container. The supporting structure or arch provides the handle without requiring a separate handle construction component that is attached or connected to the container or lid.

In another aspect, the bridge member is an integral part of the arch. Therefore, there is no assembly needed. In some aspects, the arch may have a bridge member across the groove at a predetermined position that is manufactured by injection molding, or by any other processes known in the art.

In another aspect, the bridge member may be a detachable/attachable part of the arch. To be attachable, the bridge member additionally may have two side walls each containing a bridge connection receiving member complementary to connection receiving members of the supporting structure. A detachable bridge member is convenient for thorough cleaning of the lid, as well as for part replacement when damage to the bridge member occurs.

In another aspect, a docking portion of the lid is an integral part of the arch. Therefore, there is no assembly needed. In some aspects, the supporting structure having a vent opening and the ledge for locking the door latch may be manufactured by injection molding, or by any other processes known in the art.

In another aspect, a docking portion is a detachable element at the first end of the arch. After attaching the docking portion to the lid, the docking portion is also annexed to the supporting structure with or without any additional attaching structures to keep the supporting structure and the docking portion aligned. Such design allows for using different materials between the docking portion and the arch. In some aspects, the docking portion having the vent opening and the ledge is made of material having resilience, such that the ledge and the latch can interlock or be pulled apart by using a slight manual force.

In another aspect, a rotatable connection between the door and the arch is described. Specifically, the protruding member and the connection receiving member form a rotatable connection between the door and the arch. When the protruding members at the free end of the door arm are pivotally snapped, clutched, hinged, or mounted in the connection receiving members, it allows for a rotatable connection for the door to swing between the opening and the closed positions. In one aspect, the connection receiving member is in a form of keyhole. Other similar connections also include, but are not limited to, snap fitting, rivet, screw, c-clip, or any other methods known in the art for a pivotal connection that can avoid the portion of the straw positioned in between the points of connection receiving members.

In another aspect, the lid has a pinching member as part of the door that presses against the first end of the straw towards the groove when the door is closed. As such, when the pressure is released from opening the door, the tension from the straw creates a force that automatically pops the straw out of the groove without the need to manually lift the straw up. Also or alternatively, the material used to make the straw may be of a rigidity configured to facilitate the straw generally popping out of the groove upon release of the door structure.

In another aspect, the door structure includes a lifting member. The lifting member may include a tab operable with one or two fingers. The lifting member makes it easy to open or close the door structure.

In another aspect, a supporting structure of the lid includes predetermined curves, which is in turn affected by the angle formed between the axis line through the bridge member and a plane extending from the bridge member and the ledge. The angle formed is preferred to be within a predetermined range of degrees. In some aspects, the predetermined degree range of the angle is between about 30 to 60 degrees. In some other aspects, the predetermined degree range of the angle is between about 40 to 50 degrees. In certain aspects, the angle is about 45 degrees.

All ranges provided herein include each and every value in the range as well as all sub-ranges in between, as if each such value or sub-range was disclosed. Further, all aspects and aspects of the disclosure can comprise, consist essentially of, or consist of any aspect or aspect or combination of aspects and aspects disclosed herein.

Other aspects and iterations of the disclosure are described in more detail below.

DETAILED DESCRIPTION

Figure 1:
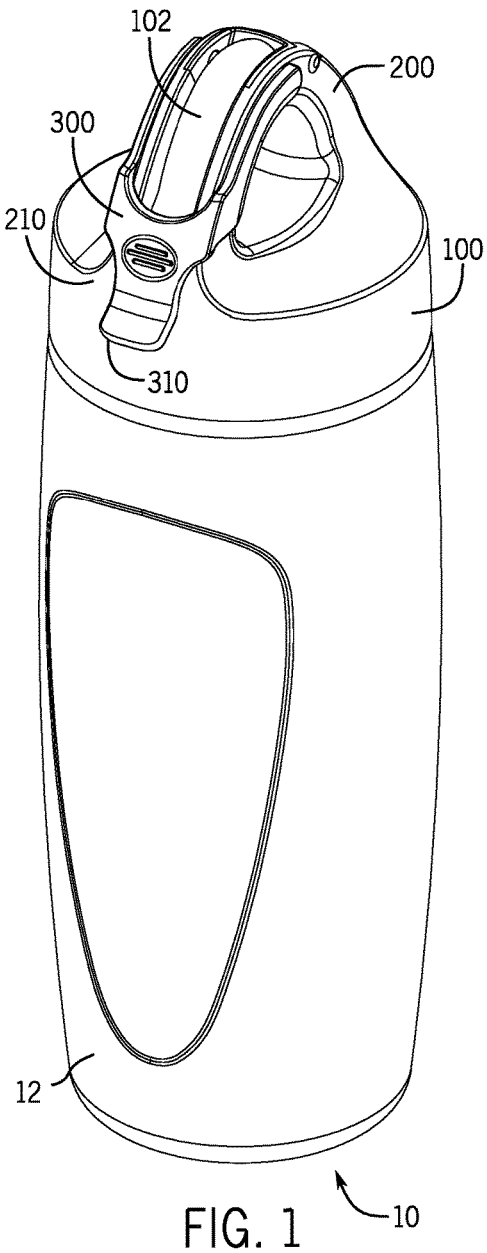
FIG. 1 is a perspective front view of an embodiment of the container and lid, with the door structure in the closed position.
Figure 2:
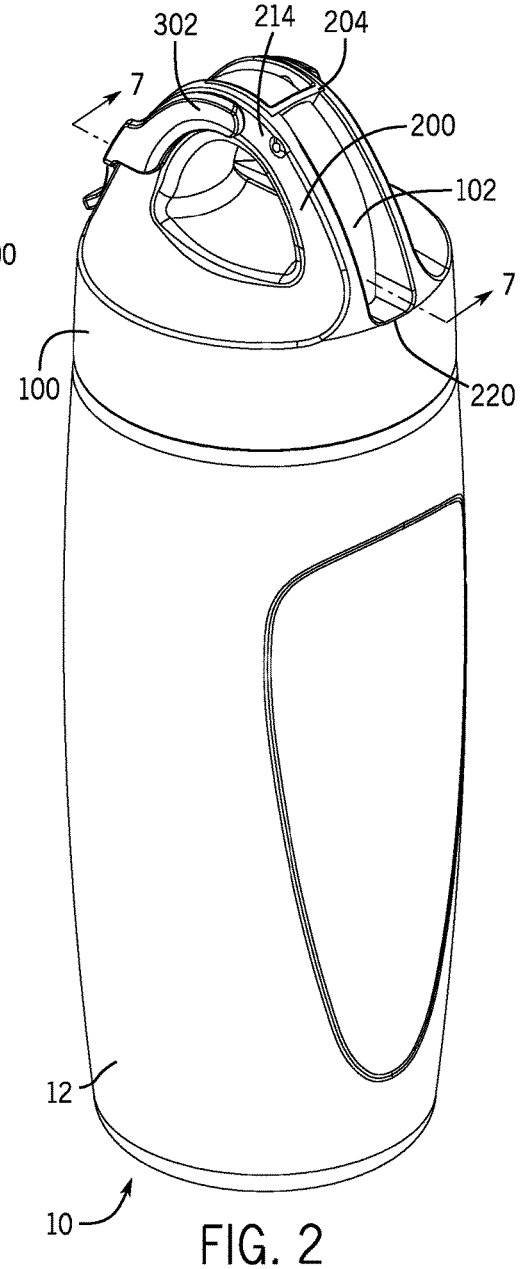
FIG. 2 is a perspective rear view of an embodiment of the container and lid, with the door structure in the closed position.
Figure 4:
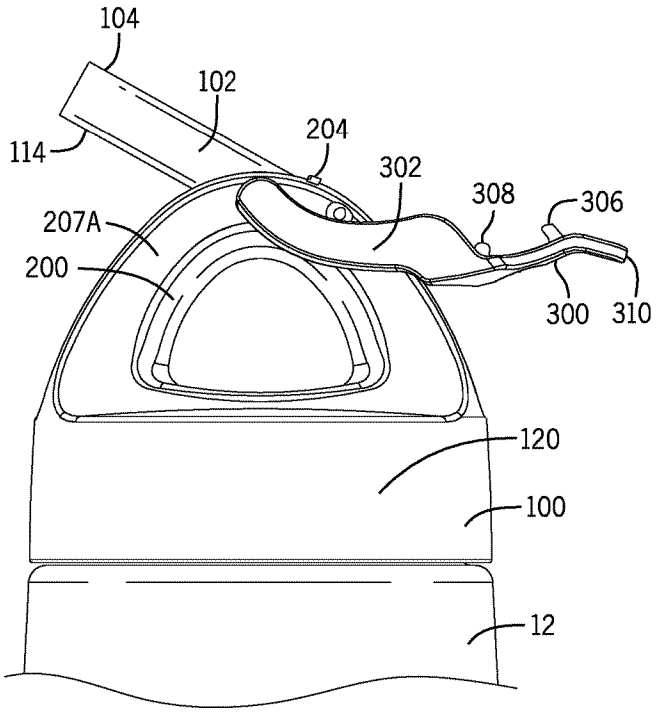
FIG. 4 is a side view of an embodiment of the lid, with the door structure in the open position.
Figure 3:
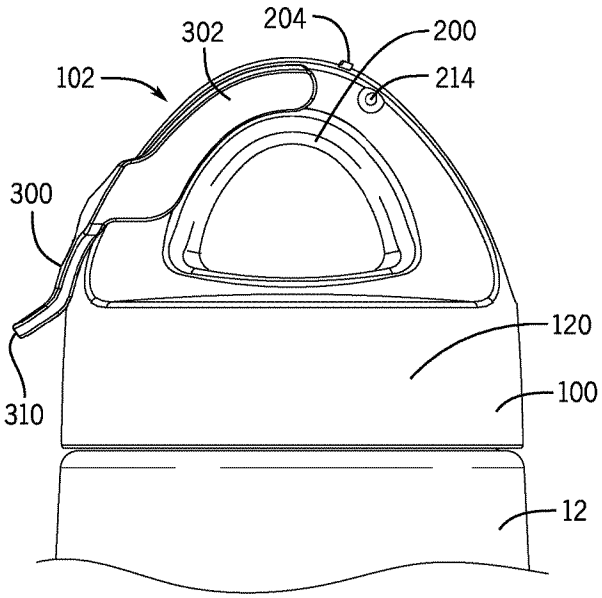
FIG. 3 is a side view of an embodiment of the lid, with the door structure in the closed position.
Figure 6:
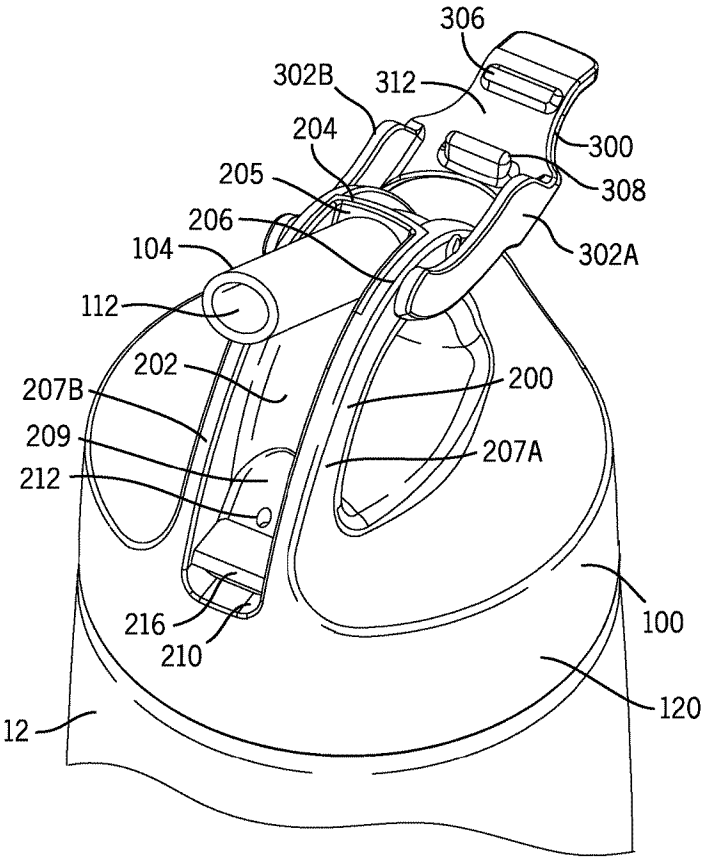
FIG. 6 is an enlarged perspective view of an embodiment of the lid, with the door structure in an open position.
Figure 5:
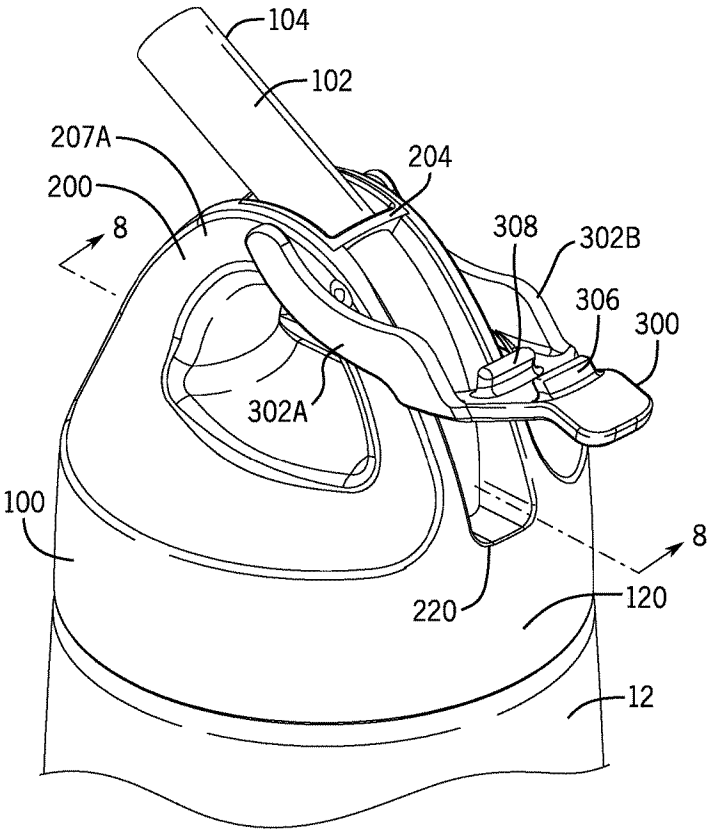
FIG. 5 is an enlarged perspective view of an embodiment of the lid, with the door structure in an open position.

For purposes of this application, any terms that describe relative position (e.g., "upper", "middle" "lower", "outer", "inner", "above", "below", "bottom", "top", etc.) refer to an embodiment of the invention as illustrated, but those terms do not limit the orientation in which the embodiments can be used.

In FIG. 1 through FIG. 11, a numerical symbol "10" represents, as a whole, a portable beverage container system of the present disclosure. The beverage container system 10 includes a main body 12 and a lid 100. The lid 100 is configured to permit dispensing or releasing of a beverage contained in the main body 12 via the straw 102 without removing the lid 100 from the main body 12. The lid 100 removably connects to the main body 12 to generally maintain the beverage in the main body 12 until the beverage is dispensed via the straw 102. The lid 100 may be removed by the user in order for the user to fill the main body 12 with the beverage. The user may then reconnect the lid 100 to contain the beverage in the main body 12. The lid 100 includes the straw 102 for the dispensing of the beverage directly to the user.

The straw 102 may be in fluidic communication with the interior space defined by the main body 12 by a variety of arrangements. For example, the straw 102 may pass through the lid 100 and into an interior space of the main body 12. The straw 102 may also pass through the lid 100 and engage with a further section of straw or a discrete second straw component that descends into an interior space of the main body 12. The straw 102 may also engage with a fluidic passage in the lid 100 configured to permit fluid to pass through the lid 100, and the fluidic passage connects with another discrete second straw component. In the aspect shown in FIGS. 1-11, the straw 102 is part of an adaptor 140. The straw 102 can be positioned to pass through a passage in the lid 100. The straw 102 leads to an adaptor body 143, which when positioned in the lid 100, generally abuts against a lower surface of the lid 100. A first end of a second straw 108 is engaged to the adaptor 140, while a second end of the second straw 108 passes further into the main body 12.

Figure 7:
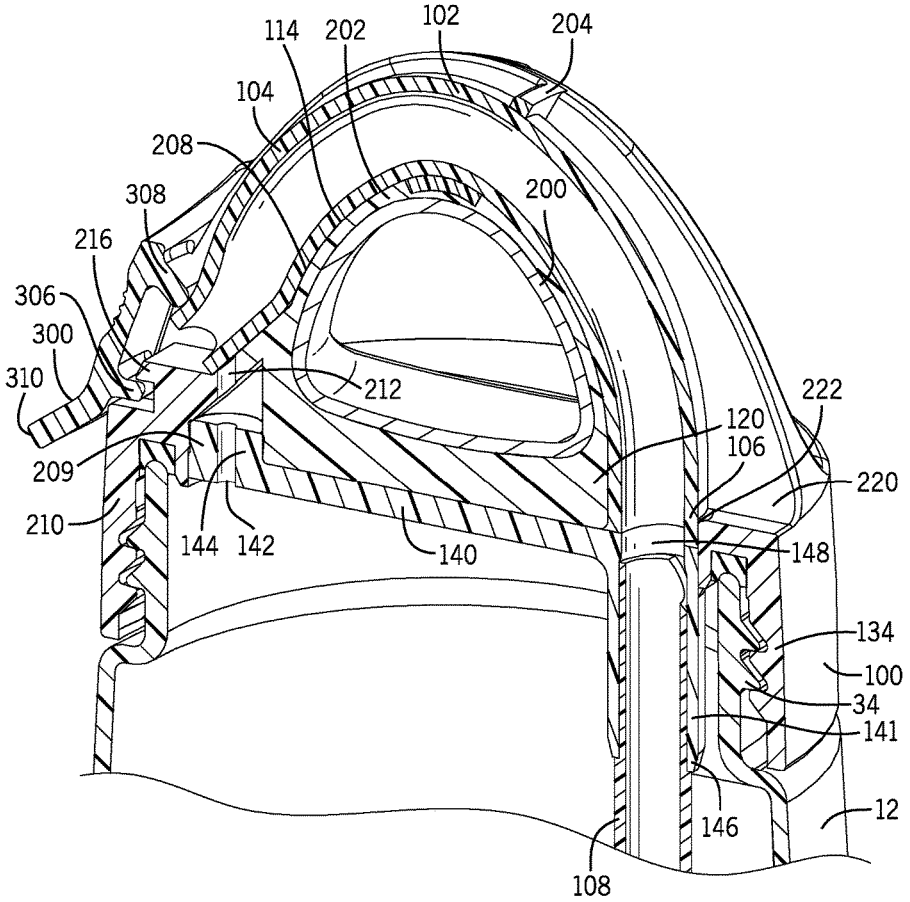
FIG. 7 is a cross-sectional view of an embodiment of the lid, with the door structure in the closed position.

With reference to FIG. 7, a first end 104 of the straw 102 is outside of the main body 12, while a second end 106 of the straw 100 is in fluidic communication with the interior of the main body 12. The first end 104 includes an opening 112 for the passage of the beverage. The straw 102 further includes an outer surface 114.

With continued reference to FIG. 7, a lid body 120 of the lid 100 includes a passage 222 for the straw 102 to fluidly engage the adaptor 140. The passage 222 provides an opening through the lid body 120 and allows the straw 102 to pass through the lid body 120 of the lid 100 to reach the adaptor 140. The adaptor 140 fluidly connects the second end 106 of the straw 102 with the lower straw 108. The lower straw 108 descends into the container 12. As shown in FIG. 7, the adaptor 140 defines or forms a connecting member 141, which connects with the lower straw 108. In other aspects, the straw 102 may include several straw sections that are force-fit or frictionally held together. For example, a first straw section may pass through the lid 100, and a second straw section may engage with the first straw section or the straw 102 may be a single piece construction.

In addition to the straw 102, the lid 100 includes a supporting structure 200 and a door structure 300 that is rotatably or pivotally attached to the supporting structure 200. The door 300 rotates or pivots between a closed position (FIG. 3) and an open position (shown in FIG. 4). In some aspects, the door structure 300 is also detachably attached to the supporting structure 200. In the closed position, the door structure 300 squeezes or pinches the straw 102 closed and also urges the straw 102 to cover a vent 212 of the lid 100.

In some aspects, the supporting structure 200 is an integral part of the lid 100. In one aspect, the lid 100 is integrated with the supporting structure 200. In some aspects, the lid 100 is made from a synthetic resin through injection molding.

Figure 8:
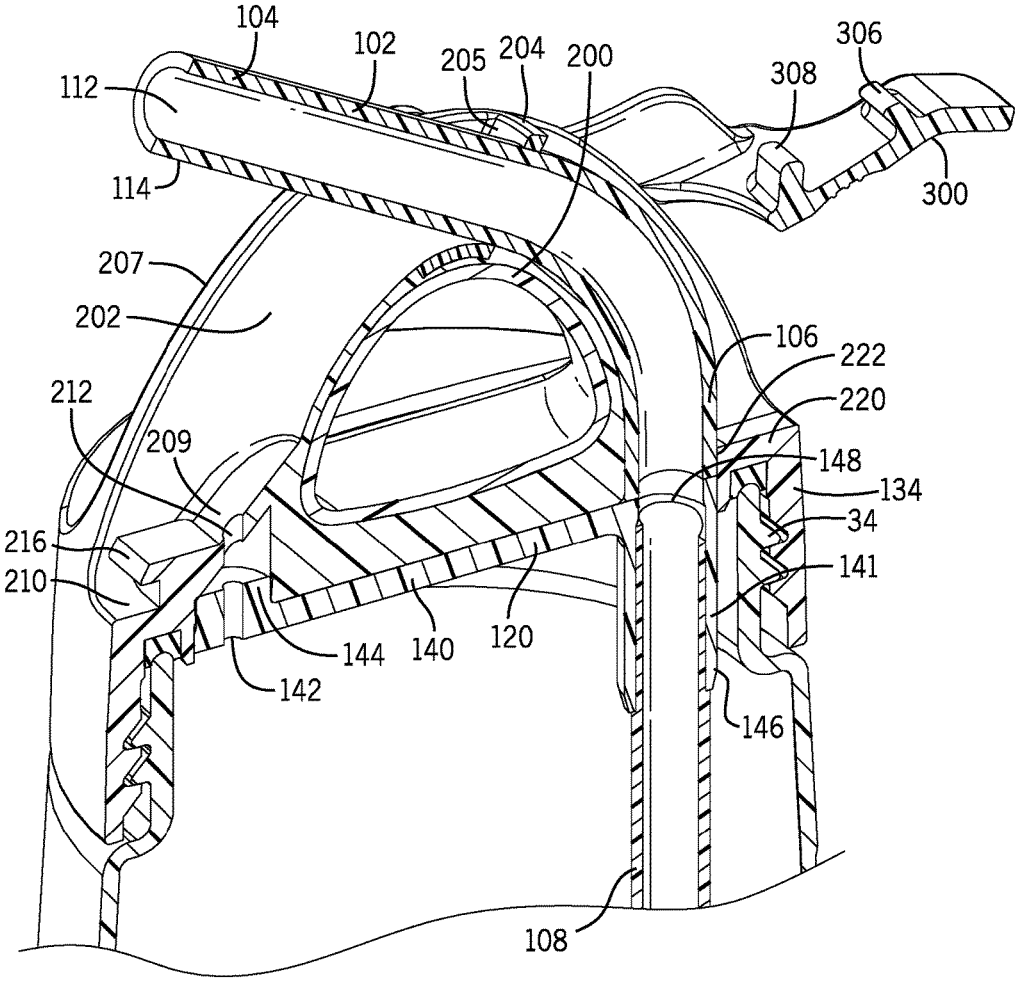
FIG. 8 is a cross-sectional view of an embodiment of the lid, with the door structure in an open position.

The supporting structure 200 includes a groove 202 for housing, receiving, or holding the straw 102. The groove 202 forms a channel or recessed region in the supporting structure 200 to receive all or part of the outer surface 114 of the straw 102. A bridge member 204 extends across the groove 202. The bridge member 204 passes over a top of the straw 102. A pair of connection receiving members 206 are positioned on side walls 207 (such as a first supporting structure side wall 207A and a second supporting structure side wall 207B) of the supporting structure 200. The side walls 207A and 207B are on both sides of the groove 202. The side walls 207A and 207B may define or form boundaries for the groove 202. The sidewalls 207A and 207B may include multiple segments or walls defining the groove 202. The groove 202 may be formed from a groove surface 208 connecting the side walls 207A and 207B. The groove surface 208 of the groove 202 be may be curved to accommodate the straw 102. The groove surface 208 may lead into or transition into the side walls 207A and 207B. The groove 202 directs the straw 102 to pass through the passage 222 of the lid body 120 of the lid 100 and into the main body 12. As shown in FIG. 8, the groove 202 may lead to the passage 222 of the lid body 120.

A docking portion 209 is at the first end 210 of the supporting structure 200. The bridge member 204 defines a bridge opening 205 to let the first end 104 of the straw 102 pass thereunder, and to position the first end 104 of the straw 102 against the supporting structure 200 and push the first end 104 of the straw 102 towards the groove 202. The second end 106 of the straw 102 extends to the second end 220 of the supporting structure 200 and goes through or leads to the passage 222 of the lid 100 to enter the main body 120. The second end 106 of the straw 102 may be integral with or connect to the adaptor 140. The adaptor 140 may receive, hold, or engage to the lower straw 108 via its connecting member 141.

The docking portion 209 at the first end 210 of the supporting structure 200 also includes a vent (or vent opening) 212 for airflow, and a ledge 216 for locking to the door structure 300 when the door structure 300 is in the closed position. The vent 212 is configured to release pressure from internal space of the container. As the user is drinking from the straw 102, the vent 212 prevents a vacuum from building up in the interior of the main body 12. The vent 212 passes through the lid body 120 of the lid 100 and is in fluid communication with an interior of the main body 12. In some aspects, the vent opening 212 and the ledge 216 at the docking portion 209 are integrally formed with the supporting structure 200, for example, by molding. As such, the docking portion 209 is an integral part of the supporting structure 200.

Figure 9A:
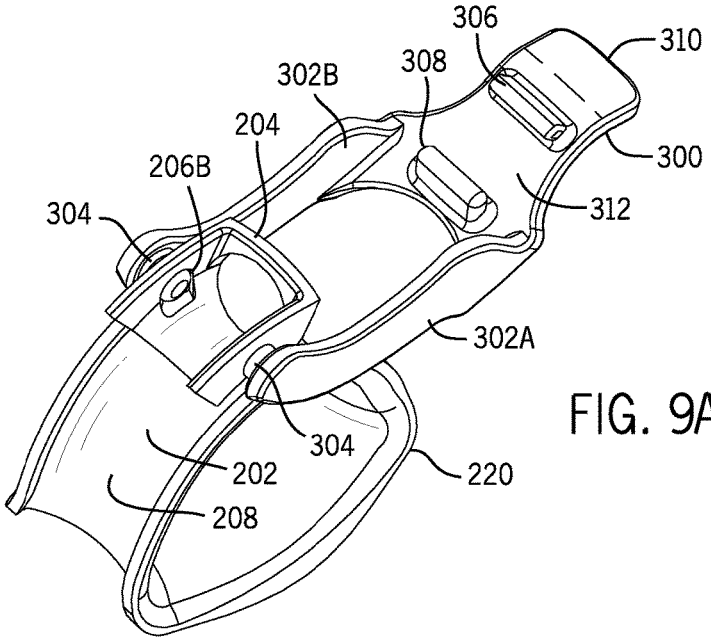
FIG. 9A is an enlarged perspective view showing an embodiment of the bridging mechanism that connects the door structure and the supporting structure.
Figure 9B:
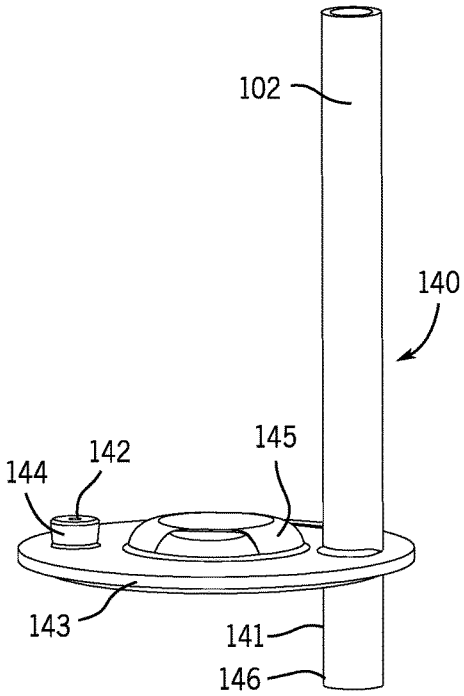
FIG. 9B is a perspective view showing an embodiment of the adaptor.

With reference to FIG. 9B, the adaptor 140 is shown. The adaptor 140 includes the main body 143. The lid body 120 receives or engages with the adaptor 140. The adaptor 140 includes a vent passage 142 in open communication with the vent 212. The vent passage 142 is positioned in a protruding gasket 144 that positions the vents passage 142 proximate the vent 212. A central protruding gasket 145 assists in positioning and maintaining the adaptor 140 on the lower surface of the lid body 120. The adaptor 140 includes the connecting member 141 with the upper opening 148 and a lower opening 146. The upper opening 148 may be integral with or connect to the second end 106 of the straw 102. In the aspect shown, the straw 102 is integral with the adaptor 140. The straw 102 passes through the passage 222 of the lid body 120 and transitions into the connecting member 141 of the adaptor 140. The second straw 108 engages with the lower opening 146 of the connecting member 141.

The supporting structure 200 may serve as a handle or a grip for the portable beverage container 10. In some aspects, the supporting structure 200 is in a shape of arch or other substantially convex surface. Such a curvature allows for the straw 102 to lay substantially flat against the supporting structure 200. The supporting structure 200 extends from the lid 100 at the first end 210 of the lid 100 and arches back down to the second end 220 of the lid 100. In the aspect shown in FIGS. 1-11, a void is formed between lid body 120 of the lid and the supporting structure 200. In the aspect of FIGS. 1-11, the passage 222 of the lid body 120 is at the second end 220 of the lid body 120 and the vent 212 is at the first end 210. Thus, in the closed position, the straw 102 passes through the lid 100 at the second end 220 via the passage 222, lies against the groove 202, and covers the vent 212 at the first end 220 of the lid 100.

With respect to FIG. 9A, the door structure 300 includes at least one arm 302, a protruding member 304 on the inner side of the arm 302, a latching member 306 that pairs with the ledge 216 of the supporting structure 200 for securing the door structure 300, a pinching member 308 to press down the end portion of the straw 102 when the door structure 300 closes, and a lifting member 310. The door structure 300 may be formed as an integral member, and all of the arm 302, the protruding member 304, the latching member 306, and the pinching member 308 may be formed integrally. The pinching member 308 extends from an underneath surface 312 of the door structure 300. The pinching member 308 has a width smaller than a width of the groove 202 such that the pinching member 308 will enter the groove 202 as the door structure 300 moves downward. The lifting member 310 may include an end portion of the door structure 300 that is flared or angled to provide an easy grasping point for the user. The lifting member 310 may include a textured outer surface to help the user identify the best surface to push when the closing the door structure 300 to facilitate securing the door structure 300.

As the door structure 300 moves downward to the closed position, the pinching member 308 squeezes or pinches the straw 102 closed or at least partially closed in the interior of the groove 202. The pinching member 308 collapses the straw 102 closed against the groove surface 208 at the bottom of the groove 202. This prevents or reduces liquid leaking from the straw 102. For example, if the container 10 is inverted while the door structure is in the closed position, then collapsed straw 102 will reduce or prevent any leakage from the container 10.

The door structure 300 is connected to the supporting structure 200 through the protruding member 304 of the arm 302 and the connection receiving members 206 on the side walls 207 of the supporting structure 200. In the aspect of FIGS. 1-11, the door structure 300 includes a first arm 302A and a second arm 302B. The first and second arms 302 pivotally or rotatably engage to an outer surface of the side walls 207. In one aspect, the connection receiving member 206 is a keyhole like opening, such that the matching protruding member 304 can be inserted in the keyhole to allow a rotatable connection between the supporting structure 200 and the door arm 302. In one aspect, the connection between receiving member 206 and the protruding member 304 are detachable. Various connection attachments are known in the art and are applicable to door structure 300 and the supporting structure 200 so as long as the connection provides movement.

When the door structure 300 is pushed down to the closed position, the first end 104 of the straw 102 is pressed down by the pinching member 308, and the first end 104 is urged into the groove 202 of the supporting structure 200. As a result, the outer surface 114 of the straw 102 lies against the vent 212 and completely or partially covers the vent 212. In the meantime, the latching member 306 of the door structure 300 interlocks with the ledge 216 of the supporting structure 200 to secure the door structure 300 in a closed position. When the door structure 300 is in the closed position, the pinching member 308 also closes the first end 104 of the straw 102 by pinching down and pressing against the straw 102. As such, both the straw 102 and the vent 212 are simultaneously closed to prevent or reduce leakage or evaporation. In some aspects, the latching member 306 and the ledge 216 are made of material with resilience.

When opening the door structure 300, a user pulls the lifting member 310 to release the latching member 306 from the ledge 216. As a result, the door structure 300 flips open, the pinching member 308 is lifted away from the first end 104 of the straw 102 to release the tension on the straw 102. The opposite force from the straw 102 automatically pops up the first end 104 of the straw 102 from the groove 202 to an upward position without the need of manual directly with the straw. The straw 102 may be made from a resiliently flexible material with enough resilience to move the door structure 300 after the latching member 306 is released. With the straw 102 being released from the supporting structure 200, the vent 212 is exposed to the air at the same time allowing airflow in and out of the container and for the straw 102 to work right away. A stop 214 is positioned on the outer surface of at least one side wall 207. In one aspect, the door structure 300 can be fixed or at least stably positioned in the open position by the stop 214 on the outer side of the supporting structure 200. In one aspect, the stop 214 is a protruding wedge with resilience, such that the arm 302 of the door structure 300 can be wedged under the stop 214 manually by using a slight force to prevent the arm 302 from swinging back to a closed position.

The lid 100 is configured to removably connect to the main body 12 to close the container system 10. As shown in FIGS. 7 and 8, the main body 12 includes threaded engagement members 34 that engage with the threaded engagement members 134 of the lid 100. In other aspects, the lid 100 and main body 12 may include other removable connection components, such as different complementary threads, snap engagement, a frictional configuration, etc.

The main body 12 and lid 100 may be made from any suitable material, including a generally rigid material, a generally flexible material, a generally insulated material, or a generally non-insulated material. Examples of main body materials include metal (e.g., stainless steel), glass, rubber, silicone, plastic (e.g., food grade plastic), or any combination thereof. An insulated material may include a double-wall vacuum insulated construction or foam insulation. In FIG. 11, the main body 12 is made from stainless steel and is used with the lid 100 of FIGS. 1-10.

Figure 10:
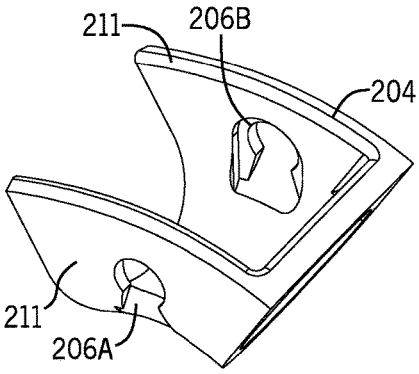
FIG. 10 is an enlarged perspective view showing an embodiment of key holes on the bridging mechanism for connecting to the door structure.
Figure 11:
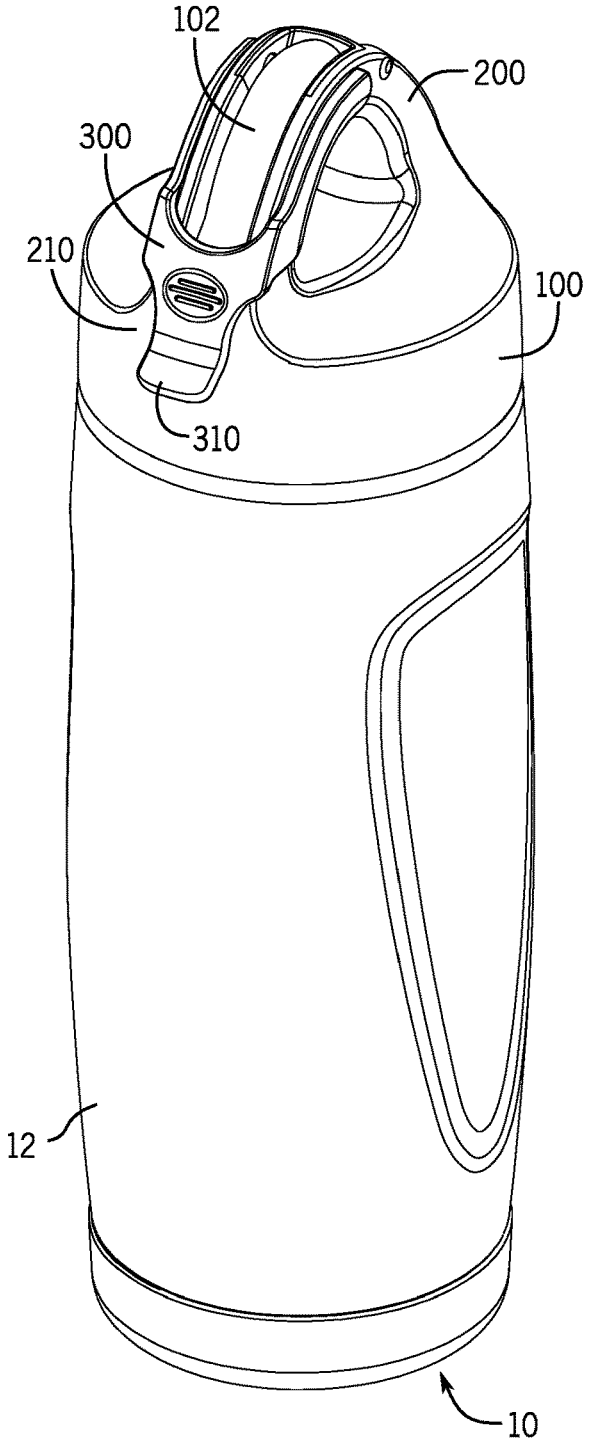
FIG. 11 is a perspective front view of an embodiment of container and lid, with the door structure in the closed position.

FIGS. 9A and 10 show a second aspect of the present disclosure. Compared to the first aspect presented in FIGS. 1 through 8 and FIG. 9B, the same numbers are applied to the same parts in the second aspect, and descriptions of the same parts thereof are skipped. The second aspect is an example of the bridge member 204 that is separately molded and then assembled to the supporting structure of the lid 100. The bridge member 204 extends across the groove 202 to direct the straw 102 to a ready position configured for a user to easily drink from the straw 102. When the bridge member 204 is manufactured separately, the bridge member 204 has two additional side walls 211, each having a connection receiving member 206 matching those on the side walls 207 of the supporting structure 200. The connection receiving members 206A and 206B of the bridge member 204 and the supporting structure 200 pair with the protruding member 304 of the door structure 300, and form a rotatable connection between the bridge member 204, the supporting structure 200, and the door structure 300.

In addition, in some aspects, the docking portion 209 containing the vent opening 212 and the ledge 216 (neither shown in FIG. 10) is manufactured separately from the supporting structure 200. Instead, the docking portion 209 containing the vent opening 212 and the ledge 216, as a separate piece, may detachably attach to the lid 100 and annex to the supporting structure 200 with or without an additional attaching means to the arch. Being able to disassemble the bridge member 204 and the door structure 300, and the docking portion 209 makes it easier to thoroughly clean the lid 100. Despite the assembly requirements, the second aspect of the present application, after being assembled, has the same advantages as disclosed in the first aspect: a minimal number of parts required to open and seal the straw 102 and the vent 212 at the same time, without risk of leakage or evaporation; optimal straw position when door structure 300 is opened; and no additional parts or attachments needed for porting the beverage container.

Further, in one aspect, the axis line through the point of the supporting structure 200 where the bridge member 204 sits and the plane extending from that point to the ledge 216 forms an angle within a predetermined range of degree. In one aspect, the predetermined angle is between about 30 to 60 degrees. In another aspect, the predetermined angle is between about 40 to 50 degrees. In yet another aspect, the predetermined angle is about 45 degrees. The predetermined angle provides a tension to pop up the straw 102 when the pinching member 308 is released from the straw. The predetermined angle also contributes to keeping the straw in an end position with an optimum direction when the door structure 300 is open, i.e., pointing towards the mouth of the user at an angle. One skilled in the art understands that by adjusting the curvature, the length and the height of the supporting structure 200, the desirable angle as disclosed herein can be achieved.

In some other aspects, one of skill in the art can modify the size, the curve or the overall shape of the arch. Further, one of skill in the art may make the supporting structure detachably attached to the surface of the lid as a modification of the aspects described herein. As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid with a straw for a beverage container, comprising:

a supporting structure comprising a first supporting structure side wall, a second supporting structure side wall, a groove formed from a groove surface connecting the first and second supporting structure side walls, and the groove surface having an arched or curved shape;

the groove sized to house a first end of the straw;

a bridge member extending from the first supporting structure side wall to the second supporting structure side wall and generally above the groove to hold the first end of the straw toward the groove, and the bridge member extending over the groove and over the straw;

a docking portion at a first end of the supporting structure, the docking portion comprising a vent opening and a ledge;

a door structure comprising a latching member, and a lifting member, wherein the door structure is rotatably connected to the supporting structure; and, the door structure rotates downward to urge the first end of the straw into the groove to simultaneously close the vent opening and to interlock the latching member of the door structure with the ledge of the docking portion when the door structure is in a closed position.

2. The lid with a straw for the beverage container of claim 1, wherein the door structure further comprises a pinching member configured to squeeze the first end of the straw to minimize leakage of beverage from the straw when the door structure is in the closed position.

3. The lid with a straw for the beverage container of claim 1, wherein the supporting structure further comprises a stop, and wherein the door structure is fixed in an open position when wedged against the stop.

4. The lid with a straw for the beverage container of claim 1, wherein the bridge member defines an opening for holding the first end of the straw and bending the straw at a fixed angle.

5. The lid with a straw for the beverage container of claim 4, wherein the fixed angle of the straw points the first end of the straw towards the mouth of a user when the door structure is in an open position.

6. The lid with a straw for the beverage container of claim 4, wherein the bridge member is an integral part of the supporting structure.

7. The lid with a straw for the beverage container of claim 4, wherein the bridge member is a detachable part of the supporting structure, and wherein the detachable bridge member has two side walls each containing a connection member complementary to connection members of the supporting structure.

8. The lid with a straw for the beverage container of claim 1, wherein the docking portion at the first end of the supporting structure is an integral part of the supporting structure.

9. The lid with a straw for the beverage container of claim 1, wherein the docking portion at the first end of the supporting structure is detachable, and wherein the docking portion is annexed to the supporting structure by attaching to the lid.

10. The lid with a straw for the beverage container of claim 1, wherein the door section includes protruding members, and the supporting structure include a pair of connection receiving members, and the protruding member and the connection receiving members form a rotatable connection between the door and the supporting structure.

11. The lid with a straw for the beverage container of claim 10, wherein the connection receiving member is in a form of keyhole.

12. The lid with a straw for the beverage container of claim 1, wherein an axis line through the bridge member and a plane extending from the bridge member and the ledge forms an angle within a predetermined range of degrees, wherein the predetermined range of degrees is between about 30 to about 60 degrees.

13. The lid with a straw for the beverage container of claim 1, further comprising a lid body with a first end opposite of a second end, wherein the vent opening is at the first end, and a passage through the lid body is at the second end, and wherein the straw engages with or passes through the passage of the lid body.

14. The lid with a straw for the beverage container of claim 1, wherein the pinching member extends from an underneath surface of the door, the pinching member has a width smaller than a width of the groove such that the pinching member will enter the groove as the door moves downward.

15. The lid with a straw for the beverage container of claim 1, wherein the supporting structure serves as a handle for carrying the beverage container.

16. The lid with a straw for the beverage container of claim 1, wherein the supporting structure extends from a first end of a lid body and curves back to a second end of the lid body, generally forming an arch.

17. The lid with a straw for the beverage container of claim 16, wherein a void is formed between an upper surface of the lid body and the supporting structure.

18. A beverage container comprising a main body and the lid with the straw according to claim 1.

19. The lid with a straw for the beverage container of claim 1, wherein the door structure rotates downward to urge the first end of the straw into the groove and against the groove surface.

20. A lid with a straw for a beverage container, comprising:

a lid body;

the lid body comprising a groove, the groove formed between a first sidewall and a second sidewall, the groove sized to receive a first end of the straw;

a bridge member extending over the groove and over the straw to hold the first end of the straw toward the groove;

a docking portion at a first end of the lid body, the docking portion comprising a vent opening and a ledge;

a door structure comprising a latching member and a pinching member, wherein the door structure is pivotally connected to the supporting structure; and, the door structure configured to pivot downward to urge the first end of the straw into the groove to cover the vent opening with the straw, to interlock the latching member of the door structure with the ledge of the docking portion, and to urge the pinching member against an exterior of the straw.

21. A lid with a straw for a beverage container, comprising:

a lid body comprising an upper surface;

a supporting structure extends from a first end of the upper surface of the lid body and curves back to a second end of the upper surface of the lid body, generally forming an arch; the supporting structure serves as a handle for carrying the beverage container; wherein a void is formed between the upper surface of the lid body and the supporting structure;

the supporting structure comprising a channel, the channel sized to house a first end of the straw;

the upper surface comprises a vent opening and a ledge;

a door structure comprising a latching member and a pinching member, wherein the door structure is rotatably connected to the lid body; and, the door structure rotates downward to urge the first end of the straw into the groove to cover the vent opening with an outer surface of the straw, to urge the pinching member against the straw, and to interlock the latching member of the door structure with the ledge.

22. A beverage container comprising a main body and the lid with the straw according to claim 21.

* * * * *